United States Patent [19]

Lancelot

[11] Patent Number: 4,671,554

[45] Date of Patent: Jun. 9, 1987

[54] HOIST COUPLING

[75] Inventor: Harry B. Lancelot, Hurst, Tex.

[73] Assignee: Richmond Screw Anchor Co. Inc., Fort Worth, Tex.

[21] Appl. No.: 763,798

[22] Filed: Aug. 7, 1985

[51] Int. Cl.[4] ..... B66C 1/36; B66C 1/66

[52] U.S. Cl. ..... 294/89; 294/87.24; 294/90

[58] Field of Search ..... 294/89, 90, 91, 92, 294/82.24; 52/125, 698, 699, 700, 701; 24/230.5 R, 232, 241

[56] References Cited

U.S. PATENT DOCUMENTS

| | | | |
|---|---|---|---|
| 2,748,646 | 6/1956 | Harold et al. | 294/89 |
| 3,499,676 | 3/1970 | Haeussker | 294/90 |
| 3,600,031 | 8/1971 | Coleman et al. | 294/90 |
| 3,883,170 | 5/1975 | Fricker et al. | 294/82.24 |
| 4,017,115 | 4/1977 | Holf et al. | 294/89 |
| 4,173,367 | 11/1979 | Haeussler | 294/89 |

*Primary Examiner*—James B. Marbert
*Attorney, Agent, or Firm*—Ralf H. Siegemund

[57] ABSTRACT

The device is an improved hoist coupling for use with anchors having an anchor shaft terminating in an anchor head and embedded in a concrete load in such a way that a portion of the anchor shaft and the anchor head is exposed and protrudes from the concrete body. The couple comprises a coupler body having an underside which is oriented towards and is seated against the load to be lifted, a socket formed in the upper side of the coupler body, in which socket is defined a ring bearing surface, and a hole in the underside of the coupler body opening into the socket for receiving the head of an anchor.

57 Claims, 13 Drawing Figures

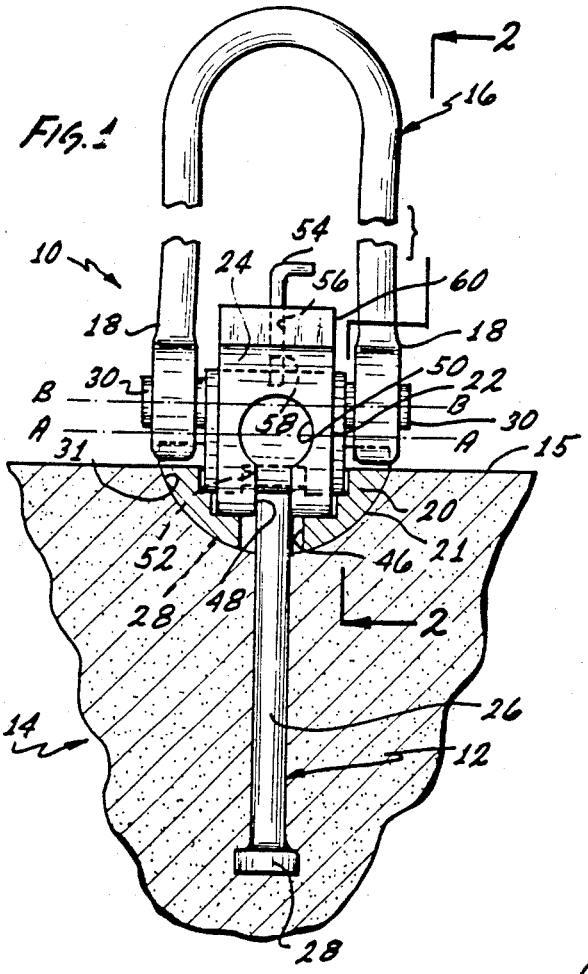
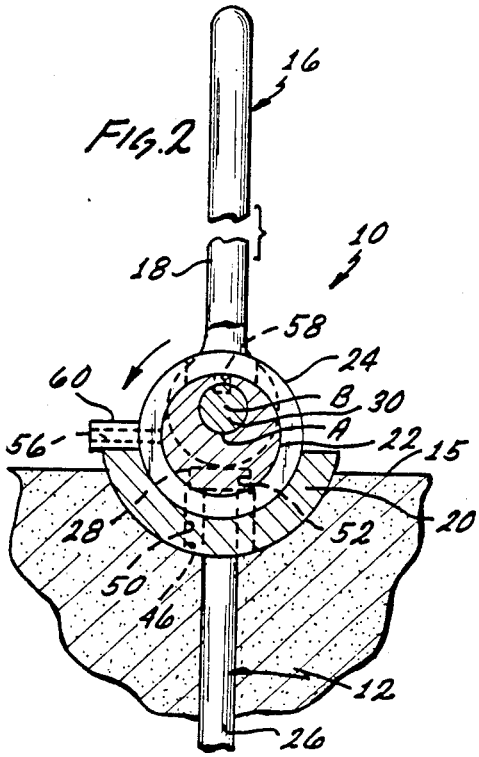
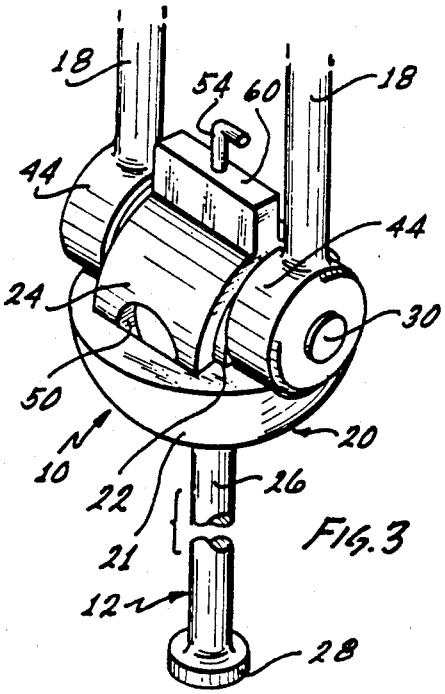
FIG. 3
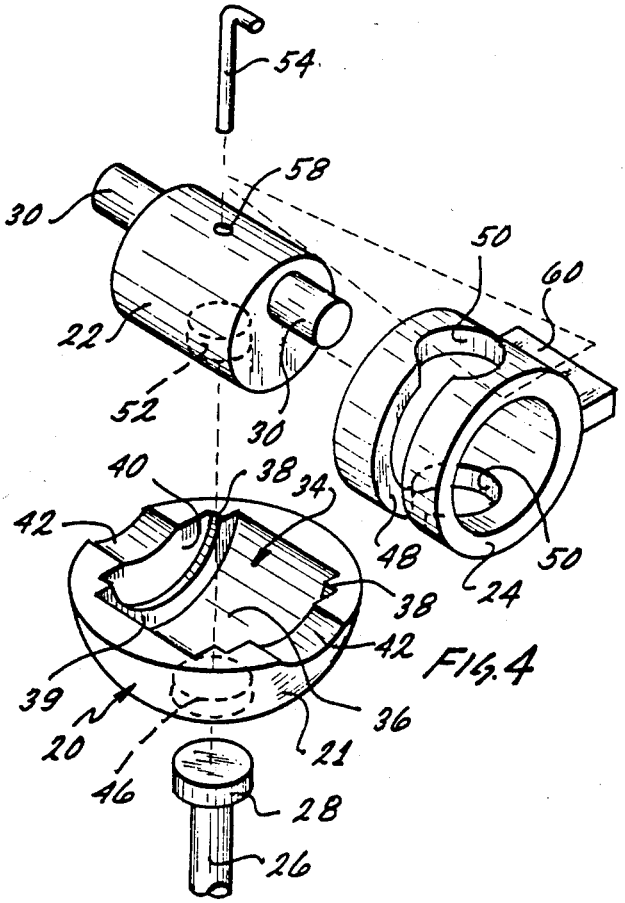
FIG. 4

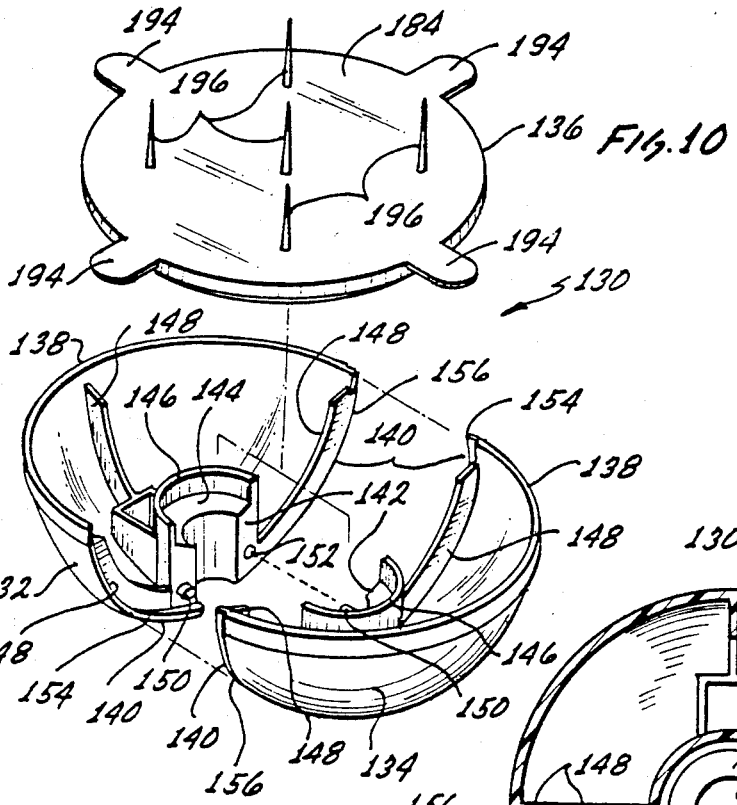
Fig. 10
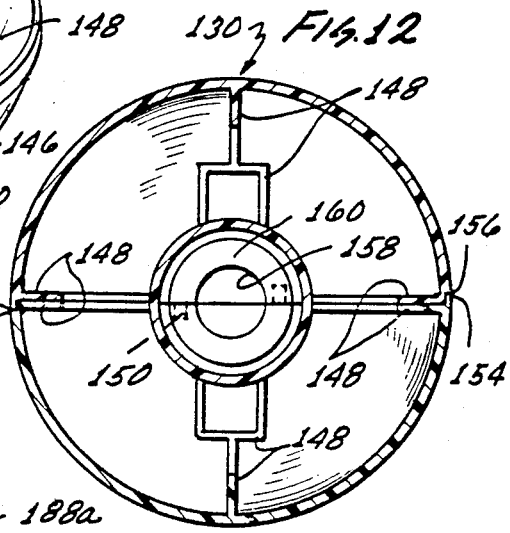
Fig. 12
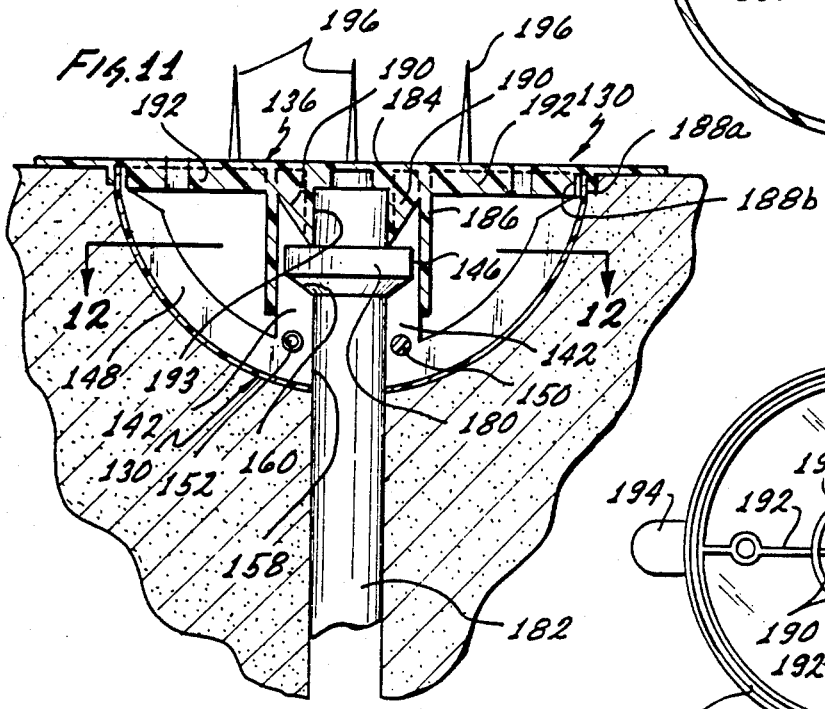
Fig. 11
Fig. 13
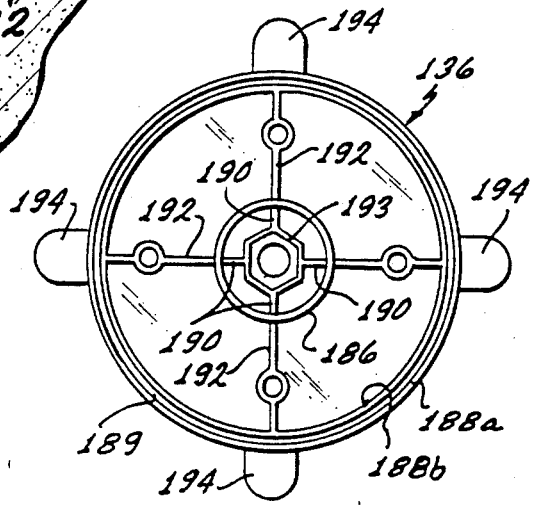

HOIST COUPLING

BACKGROUND OF THE INVENTION

1. Field of the Invention

The present invention relates generally to load hoisting and handling apparatus and more particularly is directed to a coupling releasably attachable to an anchor affixed to a load, and to devices auxillary to such a coupler including a female to male anchor adapter and a void mold for setting anchors in poured concrete structures.

2. State of the Prior Art

Modern construction practices frequently require the lifting of massive bodies of cured concrete. For example, building walls may be cast at the construction site on a horizontal surface and then erected into position once the concrete is hardened and cured.

Considerable effort has been directed in the past to development of hoist coupling devices which would allow easy and safe attachment of the cable of a hoist to a concrete structural element with a simple, low cost but reliable coupling device. Such couplers are adapted to engage either an anchor embedded in the concrete piece or an element cast as part of the total concrete structure to be hoisted.

Exemplary of such prior art, is the device disclosed by Haeussler in U.S. Pat. No. 3,499,676. The Haeussler coupler is a hollow spheroidal one piece body which provides limited articulation i.e. degrees of free rotation of the concrete structure as it is being hoisted, and which is also somewhat difficult to engage with and release from the anchor because a twisting motion of the entire coupler body is required between the anchor receiving and releasing positions while the heavy hoist cable is attached to the coupler.

Somewhat improved devices are disclosed by Haeussler, et al., in U.S. Pat. No. 4,398,762, offering better articulation and greater ease of attachment but at the expense of structural complexity and which in any event differ substantially from the construction of the present invention in the approach taken to ensure safe operation.

Wood, et al., discloses a special purpose coupling mechanism engageable to an anchor fixed to a load which allows the coupler to be easily lowered onto the anchor for attachment thereto. The anchor is received within a hollow ball member which is rotated such that the anchor head is captured within a slot defined in the ball member. This coupler is essentially of two piece construction, namely a hollow ball rotatable within a housing and does not offer sufficient articulation for use in construction applications such as contemplated by the present applicant. The Wood device is especially designed for lifting and lowering radioactive fuel rods in nuclear reactors. The weight of these rods is known and sustantially constant. Most importantly, normal handling of the reactor fuel rods is predictable and limited to movements which do not impose substantial torsional or lateral forces on the coupler so that no positive capture of the anchor head within the hollow sphere is required and none is provided. Such a hoist coupler is not suited to handling the variety of loads encountered in construction applications nor does it offer sufficient articulation to allow manipulation and positioning of the load as it is hoisted into place in such construction applications.

Still other hoist coupling devices are disclosed by Truitt, et al., in U.S. Pat. No. 4,368,914 and Bochman, Jr. et al in U.S. Pat. No. 3,437,370. Both of these devices are far more complex than applicant's novel coupler disclosed herein. Still other couplers are disclosed by Bryant in U.S. Pat. No. 3,371,951 and Holt in U.S. Pat. No. 4,367,892 which however are intended for use with anchors different from those of the present invention.

A continuing need exists for hoist couplers offering greater ease of attachment and release, improved safety and reliability with a minimum of complexity and expense of manufacture.

SUMMARY OF THE INVENTION

The present invention is an improved hoist coupling for use with anchors having an anchor shaft terminating in an anchor head and embedded in a concrete load in such a way that a portion of the anchor shaft and the anchor head is exposed and protrudes from the concrete body.

The novel hoist coupler of this invention comprises a coupler body having an underside which is oriented towards and is seated against the load to be lifted, a socket formed in the upper side of the coupler body, in which socket is defined a ring bearing surface, and a hole in the underside of the coupler body opening into the socket for receiving the head of an anchor.

A ring is seated for rotation on the ring bearing surface about a ring axis perpendicular to the anchor shaft. A circumferentially extending slot is defined in the ring, the slot including at least one opening of enlarged diameter relative to the width of the slot. The enlarged slot opening is sufficiently large to admit the head of an anchor into the ring, while the slot width is narrower than the anchor head diameter but slightly wider than the anchor shaft diameter. A yoke element extends axially through the ring, and has an anchor head receiving recess in overlying alignment with the hole in the coupler body. A bail is pivotably connected to the yoke about an axis parallel to the ring axis, but offset therefrom in a direction away from the yoke recess and coupler body.

The ring is rotatable between a first load receiving position wherein the enlarged ring opening is in alignment with the yoke recess and the hole in the coupler body for admitting an anchor head through the body and the ring into the yoke recess, and a second load locking position wherein the ring is rotated to move the enlarged opening out of alignment with the recess and the hole such that the anchor shaft extends through the coupler body hole and the ring slot but the head is locked against withdrawal from the yoke recesses by the reduced width of the ring slot. The pivotable yoke connection allows approximately 180 degrees of oscillation in a vertical plane while the anchor head is rotatable within the yoke recess through 360° in a horizontal plane when attached to the coupler.

In one embodiment of the invention the yoke element is a cylindrical body fixed against rotation to the coupler body so as to maintain the overlying relationship of the yoke recess with the anchor receiving hole in the coupler body. In a first alternate embodiment of the invention, the cylindrical yoke is not fixed to the coupler body but is only retained thereto by a pair of lugs (dog ears) fixed to the coupler body and perforated for rotatably receiving end pins on the yoke disposed along an axis parallel to but offset from the ring axis of rotation. The resulting cooperation between the yoke, ring and coupler body is such that the yoke cannot rotate about the pin axis within the coupler body socket even without being otherwise affixed thereto. In a still further embodiment of the invention, the yoke is not retained to the coupler body except by an anchor head fitted into the yoke recess and locked therein by the ring. Upon disengagement of the anchor from the hoist coupler, the coupler body is readily separable from the ring and yoke.

As a safety precaution, a locking pin may be inserted through aligned bores in the ring and the yoke for interlocking the ring and yoke against relative rotation towards the load releasing position until the pin is withdrawn. In a basic embodiment of the invention the locking pin must be pulled manually to allow rotation of the ring.

In a further embodiment of the invention a remote load release capability is provided by spring loading the aforementioned locking pin towards a release position, and providing a latch engageable for holding the pin in its safety locking position against the spring loading. A linkage may be connected to the latch so as to move the latch to a release position in response to pulling force applied to the linkage, thus allowing the pin to move to its load release position in response to the spring bias. The latch is mounted onto the ring, such that once the pin is released from its locking position the ring can also be rotated to its load release position responsive to the pulling force on the linkage thus providing full remote load releasing capability, as opposed to a basic embodiment of the invention where the safety pin must be manually pulled from the coupler unit in order to achieve load of release.

It will be appreciated that the present hoist coupler is assembled from components having simple geometric shapes which in one embodiment of the invention interfit in cooperative relationship without need for fasteners or welds to produce a solid bodied coupler which positively engages and captures the head of a load anchor. The geometric shapes required by the coupler of this invention can be obtained by machining processes as opposed to special metal casting processes required by various prior art hoist couplers, particularly those incorporating hollow sphere or spheriods. Machining allows lower cost manufacture and produces potentially stronger and more reliable parts than are often obtainable by such metal casting.

Also disclosed are adaptor devices attachable to a female anchor of the type in current use in the construction industry so as to enable coupling of the present hoisting device to such a female anchor, and an improved, reusable void mold for use in embedding anchors in poured concrete structures.

These and other advantages of the present invention will be better understood by reference to the accompanying drawings in light of the following detailed description of the preferred embodiments.

BRIEF DESCRIPTION OF THE DRAWINGS

FIG. 1 is an elevational front view partly in section showing the novel hoist coupling in a manual release embodiment.

FIG. 2 is a side elevational view partly in section taken along line 2—2 in FIG. 1.

FIG. 3 is a perspective view of the hoist coupler of FIG. 1.

FIG. 4 is an exploded view of the device of FIG. 3.

FIG. 10 is an exploded perspective view of a novel void for use in embedding anchors in poured concrete structures.

FIG. 11 is an elevational cross-section of a void attached to an anchor embedded in a concrete structure.

FIG. 12 is a cross-sectional view taken along line 12—12 in FIG. 11.

FIG. 13 is a plan view of the underside of the void lid.

DETAILED DESCRIPTION OF THE PREFERRED EMBODIMENTS

Figure 5:
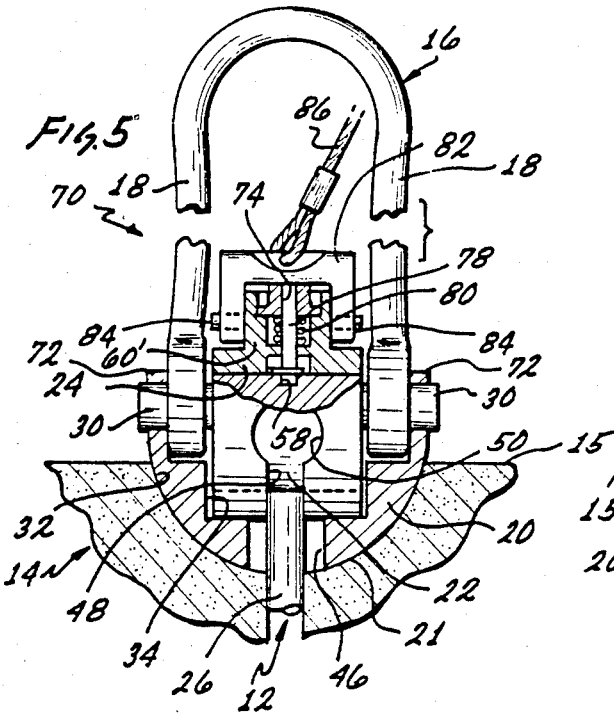
FIG. 5 is an elevational view partly in section of an alternate embodiment of the hoist coupler featuring remote load release capability.

With reference to the drawings, FIG. 1 shows the coupler 10 connected to an anchor 12 embedded in a poured concrete load 14.

The anchor 12 consists of a straight cylindrical shaft 26 terminating at each end in a cylindrical anchor head 28 of enlarged diameter relative to the anchor shaft 26. The anchor 12 is embedded into the poured concrete with an upper portion of the anchor shaft extending into a hemispherical depression 30 formed in the structural concrete member 14 with the aid of a mold in a manner which will be explained below in connection with FIGS. 10–12 of the drawings.

As shown in FIGS. 1–4, the coupler includes a U-shaped bail 16 having two generally parallel downwardly extending bail arms 18, a coupler body 20, a yoke 22, and a ring 24.

The yoke 22 is a cylindrical body extending axially through the ring 24 and having a diameter slightly smaller than the inner diameter of the ring 24 so that the ring 24 is rotatable about the yoke 22 about a ring axis A—A common with the longitudinal axis of the cylindrical yoke. The bail is pivotably attached at the lower ends of its two arms to the yoke by means of an end pin 30 extending from each end of the yoke. The yoke extends between the two bail arms and each end pin 30 fits into a pin opening formed in the lower end of each bail arm 18 so as to allow rotation of the bail relative to the yoke about an axis B—B centered through the end pins 30 as indicated in FIGS. 1 and 2.

Both the ring and the yoke are seated in a socket 34 formed in the coupler body 20 as best seen in the exploded view of FIG. 4. The socket 24 includes a central semi-cylindrical surface or race 36 on which is rotatably slidable the cylindrical outer surface of the ring 24 about the ring axis A—A perpendicular to the anchor shaft 26 as shown in FIG. 1. The socket 34 also includes a pair of shoulders which define end surfaces 39 perpendicular to the surface 36 and two semi-cylindrical yoke bearing surfaces 38. The yoke bearing surfaces and ring race 36 are cylindrical in curvature about the ring axis A—A and coaxial with each other. The end surfaces 39 hold the ring 34 within the socket against axial movement relative to the body 20, while the yoke 22 is held against axial displacement relative to both the ring 24 and the body 20 by end surfaces 40 of the socket 34.

The connector body 20 has a hemispherical underside 21 and a center hole 46 in its underside which opens into the bottom of the ring race 36. The ring 24 has a slot 48 which extends approximately 180 degrees about the ring circumference and terminates at each end in a circular opening 50 of larger diameter than the width of the slot 48. The yoke 22 has a cylindrical blind bore recess 52 formed radially into the yoke and centered between its ends so as to be in overlying alignment with the hole 46 when the yoke is seated on surfaces 38 in the coupler body 20. In a presently preferred embodiment of the invention the yoke recess is held in such overlying alignment by affixing the yoke to the coupler body 20, as by welding at the yoke ends in the area of bail recesses 42 provided in the coupler body 20 in the embodiment of FIGS. 1–4. Two semi-cylindrical bail recesses 42 are coaxial with end pins 30 of the yoke and are shaped to admit the cylindrically curved surfaces 44 at the lower ends of the bail arms 18.

The axis of the main cylindrical body of the yoke 22, is the same as the ring axis A—A in FIG. 1. The bail axis B—B is parallel to but offset from the ring axis A—A in a direction opposite to the location of the yoke recess 52. The upwardly offset bail axis positions the lower ends of the two bail arms above the concrete surface 15 when the coupler body is seated in cavity 31 thereby to allow unimpeded pivotal movement of the bail through an arc of approximately 180 degrees or greater, such that the upper end of the bail can be laid against the concrete surface at each extreme of its arc of movement.

With the coupler unit 10 assembled as shown in FIGS. 1–3, the ring 24 is rotatable between a first load engaging or releasing position and a second load locking position. In the first position of the ring 24 one of the enlarged openings 50 is positioned in alignment with the hole 46 in the body 20 and the recess 52 in the yoke 22. The dimensions of all three of the hole 46, openings 50 and recess 52 are such as to readily admit the anchor head 28 into the yoke recess 52. Desirably the anchor head 28 mates closely into the yoke recess 52 so as to prevent any substantial looseness or play of the anchor head within the yoke recess and thereby secure the anchor relative to the coupler device.

The coupler 10 is attached to the load structure 14 by seating the hemispherical underside of the coupler body 20 into the hemispherical depression 31 in the structure 14, thus inserting the protruding anchor head through the body hole 46, ring opening 50 and into the yoke recess 52. The coupler is then locked to the load by rotating the ring 24 approximately 90 degrees so as to move the ring opening 50 out of alignment with the recess 52. The width of the slot 48 is somewhat wider than the diameter of the anchor shank 26 but smaller than the diameter of the anchor head 28. Thus, in the locked position the anchor shaft 26 extends through the slot 48 of the ring but the anchor head 28 is captive and locked against withdrawal from the yoke recess 52 due to the reduced slot width of slot 48 in ring 24. The coupler 10 is shown in its load locking position in FIGS. 1 and 3, and in the load releasing position in FIG. 2.

Figure 9:
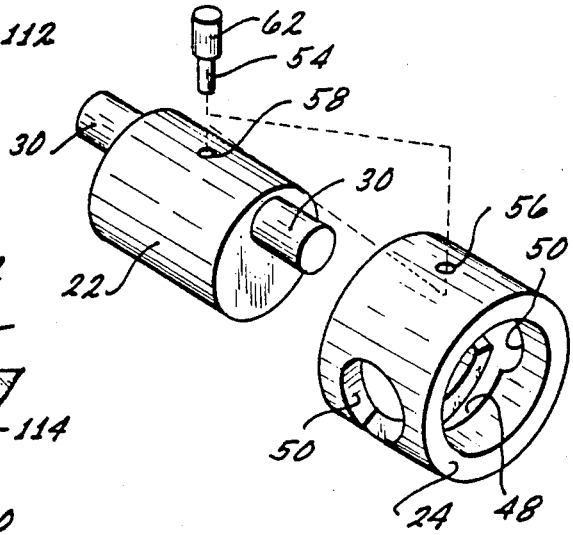
FIG. 9 shows an alternate safety pin for interlocking the yoke and ring of the present coupler to prevent accidental load release.

Desirably the hoist coupler 10 is provided with a safety locking pin 54 which is insertable through a first bore 56 in the ring 24 and a second bore 58 in the yoke 22. When the ring is moved to the load locking position the bores 56 and 58 are aligned and the locking pin 54 inserted therethrough locks the ring against rotation relative to the yoke and consequently also relative to the coupler body 20. Release of the anchor 12 in this locked position becomes impossible until the safety pin 54 is removed to allow rotation of the ring 24 to the release position as illustrated in FIG. 2. The ring 24 is preferably provided with a radially extending rectangular tab 60 circumferentially intermediate the two slot openings 50 such that it is disposed vertically and a way from the body 20 when the ring is in its locked position as shown in FIG. 3, the pin bore 56 extending radially through the tab 60. In an alternate form of the invention illustrated in FIG. 9, the radial tab 60 is absent and ring 24 has a smooth outer cylindrical surface. In this alternate form of the invention the safety locking pin 54 may take the modified configuration shown in FIG. 9 where an enlarged pin head 62 has been provided at the outer end of the safety pin in lieu of the right angle elbow bend provided in the safety pin of FIGS. 1–4, both constructions being intended to facilitate manipulation of the pin during insertion and extraction, the purpose and operation of the pin remaining the same in either case.

Figure 6:
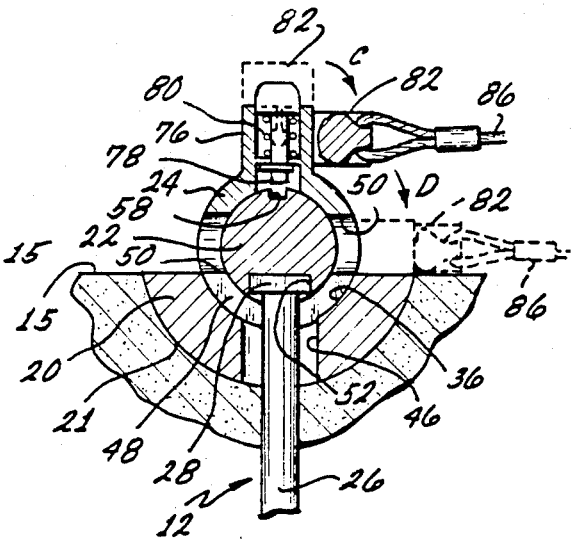
FIG. 6 is a side elevational section of the device of FIG. 5 illustrating the operation of the remote release mechanism.

The embodiments of FIGS. 1–4 and FIG. 9 require that the safety locking pin 54 be manually pulled from the coupler device in order to achieve load release. FIGS. 5–6 illustrate an alternate hoist coupler device 70 provided with remote or ground load release capability. The general construction and operation of the hoist coupler 70 of FIG. 5 and 6 is similar to the device described in connection with FIGS. 1–4 and common elements bear similar numbering.

The device of FIG. 5 is provided with a pair of ear lugs 72 integral with and extending upwardly from the connector body 20. The lugs 72 are apertured for pivotably receiving the end pins 30 of the yoke 22. The provision of the lugs 72 may be instead of or in addition to welding of the yoke to the coupler body 20 in the manner described in connection with the embodiment of FIGS. 1–4. In FIGS. 5–6 even without such welding the lugs 72 prevent rotation of the yoke 22 relative to the coupler body 20 because the end pins 30 are offset from the yoke's axis and thus cooperate in securing the yoke against rotation within the socket 34 even without welding of the yoke. Provision of such ear lugs 72 is desirable in larger hoist couplers intended for heavier loads. The coupler of FIGS. 1–4 may be constructed around a connector body approximately 3 inches in diameter and may be suitable for hoisting loads up to two tons. A heavier duty coupler such as shown in FIG. 5 may include a 4 inch diameter coupler body 20 for use with heavier loads.

The device of FIG. 5 has a radial pin bore 58 in the yoke 22 and a second radial pin bore 74 in a rectangular tab 76 extending radially from the ring 24 circumferentially intermediate the two enlarged openings 50. A locking pin 78 extends through the first and second pin bores 74 and 58 respectively so as to interlock the ring 24 against rotation about the yoke 22 and prevent release of the load anchor 12. The locking pin 78 is normally biased radially outwardly by spring 80 towards an unlocked position where the lower end of the pin is withdrawn from the yoke pin bore 58. A U-shaped latch 82 is pivotably secured to the tab 76 by means of pins 84 and is movable between an upright or locking position illustrated in FIG. 5 and a release position shown in FIG. 6 in solid lining. In the locking position the latch clip 82 overlies the head of the safety pin 78 and thus holds the safety pin against the bias of spring 80 within the pin bore 58 of the yoke, and therefore keeps the coupler 70 locked against load release. A lanyard 86 of any desired length is connected to the center of the U-shaped latch 82 and by pulling on the lanyard 86 from a remote position it is possible to pivot the latch 82 from the locking upright position suggested in dotted line in FIG. 6 to a pin releasing position shown in solid lining as indicated by arrow C. As the latch 82 is pivoted downwardly, the pin 78 is freed to respond to the spring bias by moving radially outwardly and out of the pin bore 58 in the yoke. The ring 24 is thus released for free rotation relative to the yoke 22 and coupler body 20. By applying further pulling force on the lanyard 86 the ring 24 may be rotated from its load locking position shown in solid lining in FIG. 6 to a load releasing position at a 90 degree angle to the load locking position as indicated by arrow D. This remote release capability is operational only so long as the load is not suspended from the coupler device, i.e. only while the load rests on a ground surface. If the load is suspended from the coupler the weight of the load is transmitted through the anchor shaft 26 to the anchor head 28 which bears down on the ring 24 frictionally locking the ring against its bearing surface 36 in the socket 34, such that no reasonable amount of force applied to the lanyard 86 would be effective in rotating the ring 24 towards its load releasing position, even if the safety pin 78 were accidentally remotely released through lanyard 86. This is a safety feature which is shared with the embodiment of FIGS. 1–4, which device is similarly locked by the weight of the load suspended therefrom such that the ring 24 is locked by friction with its bearing surface against rotational movement within socket 34. Thus once a load has been hoisted with the coupler device in a load locking condition, release of the load is not possible until the load is deposited and the weight no longer exerts a locking force on the ring 24.

In connection with the coupler shown in FIGS. 1–4, although it is presently preferred to affix the yoke 22 to the coupler body 20 as by welding, it must be understood that the geometry and cooperation of the various components is such as to allow the construction of a fully operational hoist coupler without affixing the yoke to the coupler body. The yoke recess 22 is in overlying alignment with the coupler body hole 46 when the end pins 30 are at the uppermost point of the circular trajectory that would be described by the offset-axis end pins upon rotation of the yoke about the ring axis A—A. In this uppermost position, the end pins are received within corresponding openings in the bail arms 18, while the lower ends of the bail arms are received in recesses 42 of the coupler body. It will be appreciated that any attempted rotation of the yoke 22 within the ring 24 and relative to the coupler body 20 would involve a downward movement of the end pins 30 towards the coupler body 20. Since the end pins 30 are captive within the bail arms 18 which themselves are in contact or in near contact with the coupler body 20, downward movement of the lower ends of the bail arms 18 is not possible and the yoke 22 is thus locked against rotation relative to the body 20 thereby maintaining the yoke recess 52 in alignment with the coupler body hole 46 at all times. In such an embodiment the coupler body 20 is not secured to the other components of the device except through an embedded anchor 12 when the coupler 10 is connected to a concrete structure load. When locked to the anchor 12, the yoke and ring are held seated on their respective bearing surfaces in the socket 34 by the captive anchor head 18, which thus holds the coupler body securely in the cavity 31 of the structural load element 14, between the ring 24 and the concrete mass. In the embodiment of FIGS. 5 and 6 the yoke 20 is similarly held against rotation within the coupler body socket 34 due to the offset axis defined by the two end pins 30. However, because of the provision of ear lugs 72 the coupler body 20 is retained to the yoke, ring and bail absent any welding of the yoke to the coupler body and absent an anchor 12 captive within the yoke recess 52. For this latter embodiment it is presently preferred to simply retain the yoke to the coupler body by means of the ear lugs 72 without additional welding or attachment of the yoke to the coupler body.

Figure 7:
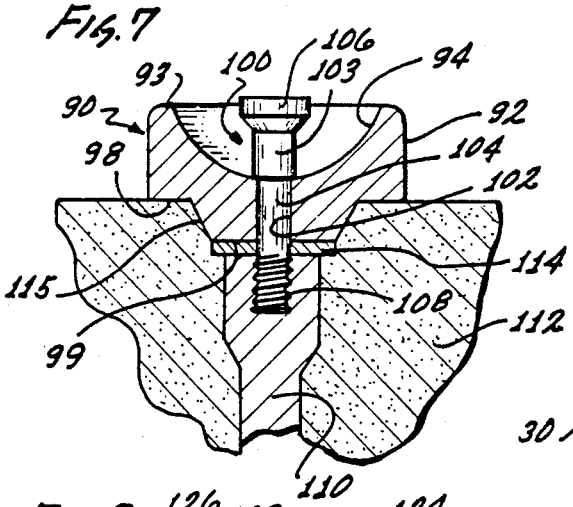
FIG. 7 is an elevational cross-section of a novel female-to-male anchor adapter attached to a female anchor set in poured concrete structure.

Turning now to FIG. 7, a novel female-to-male adapter 90 is illustrated which comprises an adpater body 92 having an upper side 93 in which is formed a spherically curved socket 94. A frustoconical projection 96 extends downwardly under the socket 94. The tapering projection 96 defines an annular shoulder 98 at its base, and terminates in an underside surface 99. A bore 102 extends axially through the frustoconical portion 96 and opens into the center of socket 94. A male anchor 100 having a shaft 104, an anchor head 106 and a threaded lower end 108 is disposed through the bore 102 in the adapter body and can be threaded into a female anchor 110 embedded in a concrete structure 112. The female anchor 110 is of a type commonly used in the construction industry and need not be described in detail here. Briefly, its upper end has an axial bore with female threading formed therein into which is threaded the lower end of the male anchor 100 of the adapter. A washer 114 which may be integral with the female anchor 110 is normally interposed between the adapter body 92 and the female anchor 110. Use of an washer 114 is not essential to the adapter however. The adapter 90 enables the use of the hoist couplers illustrated in FIGS. 1–6 with conventional female anchor bolts such as are currently in use but intended for hoist coupling devices other than those disclosed herein.

Figure 8:
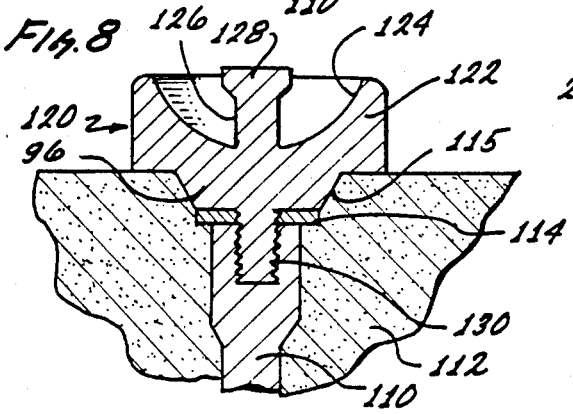
FIG. 8 shows in elevational cross-section an alternate form of the female-to-male adapter.

FIG. 8 illustrates an alternate form of the female-to-male adapter wherein an adapter unit 120 comprises a body 122 which has an upper side wherein is formed a spherically curved socket or depression 124 similar to socket 94 in FIG. 7. Unlike the device of FIG. 7, the adapter of FIG. 8 has a male anchor integrally formed with the adapter body 122, comprising an upper shaft portion 126 terminating at its upper end in an anchor head 128, and a lower anchor shaft portion 130 threaded for engagement with the female anchor 110.

In FIG. 7, the anchor 100 has an upper shaft portion 103 of enlarged diameter relative to the lower shaft portion 104. The portion 103 is enlarged relative to the bore 102 so as to stop entry of the anchor 100 through the bore 102 at a predetermined point and thereby position the anchor head 106 in proper relationship to the socket surface 94, such that when the hoist coupler of FIGS. 1–6 is seated in socket 94, the male anchor head 106 will just seat into the yoke recess 52 of the hoist couplers 10 or 70. In FIG. 8 the anchor head 128 is formed as a unit with shaft portion 126 and adapter body 122 so that the male anchor head 128 is fixed in the proper relationship so as to readily fit into the yoke recess when attached to the hoist coupler. In either embodiment of the adapter the tapering annular shoulder surface reacts to shear by redirecting lateral forces imposed on the concrete surrounding the lower portion 96 downwardly into the concrete mass to avoid breaking off the concrete surrounding the shoulder. The adapters of FIGS. 7 or 8 can be used with the female anchor recessed below the concrete surface as shown through use of a frustoconically shaped setting plug which is subsequently removed to leave the cavity into which seats the lower portion 96 of the adapters 90 and 120. The two adapters shown can however be used with the female anchor 110 mounted flush with the concrete surface or slightly recessed into the concrete structure.

FIGS. 10–13 show a void or mold device 130 for use in embedding a male anchor similar to anchor 12 of FIGS. 1–6 in a fluid mass of freshly poured concrete. The void 130 forms the spherically curved depression in the poured concrete structure of FIGS. 1–6 into which is seated the hemispherical underside 21 of the coupler body 20 of hoist coupler 10 or 70, while at the same time correctly positioning the anchor head in relation to the spherical depression formed. As shown in FIG. 10, the void 130 comprises two quarter-spherical segments 132 and 134 and a cover or lid 136. Each segment 132, 134 has a semi-circular upper edge 138 and a common semi-circular edge 140. Each segment further comprises a semi-cylindrical structure 142 which defines at its upper end one half of a frustoconical seat 144 and one half of a cylindrical wall 146. Reinforcing ribs 148 are formed integrally with the segments 138 for improved rigidity of the spherically curved outer shell walls of the two segments. Each segment 138 further includes a pin 150 projecting from the semi-cylindrical structure 144 towards its opposite similar portion on the other segment 138 and mateable to a hole 152 formed therein. The edge 148 is extended to provide a quarter circular lip 154 while the edge 140 of the same segment but on the other side of the central structure 142 is undercut to accept a similar lip 154 formed on the opposite segment 138. Thus when the two segments 138 are joined along their common edges 140 to jointly define a hemi-spherical shell, the two segments are interlocked by the mating of pins 150 with pin holes 152 and interfitting of the lips 154 with the corresponding undercuts 156.

When the segments are joined, the two semi-cylindrical structures 142 define a cylindrical central bore 158 and a seat 160 for an anchor head 180 sized to closely fit about the shaft 182 of an anchor. The outer wall 146 closely surrounds the anchor head 180 further preventing lateral movement of the anchor head.

The two segments 138 are secured together by means of a cover 136 which has a top surface 184 and an undersurface from which extend an inner cylindrical sleeve 186, a spacer 193, and two concentric spaced apart outer circular ridges 188*a* and 188*b* defining between them a circular groove 189. When the cover 136 is fitted onto the upper edges 138 of the joint segments 132 and 134, the upper edges 138 are received within the groove 189 and the cylindrical sleeve 186 fits over the joint semi-cylindrical portions 142 thereby retaining the two segments against separation along their common edges 140. The cover further includes radial ribs 192 for improved rigidity. A hexagonal tubular structure 193 is centered within the sleeve 186 and is reinforced on its outer side by the triangular webs 190 which extend in the space between the hexagonal structure and sleeve 186. The lower edge of the spacer structure 193 defines the upper stop for the anchor head 180 and prevents the anchor from sliding upwardly relative to the hemispherical shell and away from the anchor head seat 160. The anchor head 180 is thus fixed in proper relationship to the hemispherical outer shell between the seat surface 160, annular wall 146, and upper stop 193.

The cover 136 further comprises four radial tabs 194 which can be more readily grasped to facilitate separation of the lid 136 from the joint void segments and are also useful in leveling the void within the cement mass. A number of locating bristles 196 extend upwardly from the top lid surface 184 and serve to facilitate location of the void and anchor after the cement structure has been poured and hardened, particularly in cases where some cement spills over and covers the void lid. In such cases the bristles will extend through the covering layer of cement to mark the location of the anchor 182. The covering layer of cement is usually easily broken away and the lid 136 can then be pulled away from the two segments 132, 134 which can then each be slid away from each other and out of the hemispherical cavity in the cement body, leaving the anchor head exposed within the hemispherical cavity so formed and ready for attachment to a hoist coupler 10 of the type earlier described.

It will be appreciated by comparison of FIG. 11 and FIGS. 1, 2, 5 and 6 that the void unit defines a smaller segment of a sphere than that comprised by the coupler body 20 of couplers 10 and 70. This provides for a portion of the coupler body remaining above the cement surface 15 of a load structure to thus preserve the spacing of the end pins 30 above the cement surface 15 and unimpeded pivotal movement of the bail 16 through the 180 degrees arc referred to earlier, allowing the bail to be laid down against the cement surface at either extreme of the arc.

The void unit is preferably molded of high density polyethylene and is reusable.

While particular embodiments have been illustrated and described for purposes of clarity, still further alterations, substitutions and modifications will become apparent to those possessed of ordinary skill in the art and the scope of the invention is defined only by the following claims.

What is claimed is:

1. A hoist coupler for use with an anchor embedded in a load, the anchor having a shaft portion and an anchor head of enlarged diameter relative to said anchor shaft protruding from said load, said hoist coupler comprising:

a coupler body having an underside, a socket formed in its upper side defining a ring race, and a hole in said underside opening into said socket;

a ring seated for rotation on said ring race, a circumferentially extending slot in said ring, said slot including at least one opening of enlarged diameter relative to the width of said slot;

a yoke extending axially through said ring, there being an anchor head receiving recess in said yoke;

a bail pivotably connected to said yoke; and means for holding said yoke against rotation relative to said coupler body with said yoke recess in overlying alignment with said coupler body hole;

said ring being rotatable about said yoke within said socket relative to said coupler body between a first load receiving and releasing position wherein said recess, said least one enlarged opening and said hole are aligned for admitting an anchor head through said body and said ring into said yoke recess, and a second load locking position wherein said ring is rotated to move said enlarged slot opening out of alignment with said recess and said hole such that the anchor shaft extends through said slot but the head is locked against withdrawal from said recess by the reduced width of the slot.

2. The coupler of claim 1 wherein said means for holding said yoke comprise means affixing said yoke to said coupler body.

3. The coupler of claim 2 wherein said yoke is affixed to said coupler body by welding thereto.

4. The coupler of claim 1, wherein the pivot axis of the bail relative to said yoke is parallel to but radially offset from the axis of rotation of said ring about said yoke in a direction away from said yoke recess, said bail being held against movement towards said coupler body so as to prevent rotation of said yoke within said socket and thereby maintain said yoke recess in alignment with said hole in the coupler body.

5. The coupler of claim 1 wherein said bail has two arms each having a lower end, said yoke is a cylindrical body having a central axis common with the axis of said ring and is supported between said lower ends of the bail arms at points radially offset from said central axis in a direction away from said yoke recess, and said lower ends are held against movement towards said coupler body thereby preventing rotation of said yoke within said socket.

6. The coupler of claim 5 wherein said lower ends of said bail arms are received within recesses defined in said coupler body.

7. The coupler of claim 1 wherein said means for holding said yoke comprise lug ears provided on said coupler body, said yoke being supported between said lug ears at points contained in an axis radially offset from the axis of said ring, said bail being pivotably attached to said yoke also along said offset axis.

8. The coupler of claim 7, wherein said yoke has cylindrical end pins rotatably extending through openings in said bail arms and said lug ears.

9. The coupler of claim 1, further comprising linkage means connected to said ring for effecting rotation of said ring from said second to said first position responsive to pulling force applied to said linkage means from a remote location.

10. The coupler of claim 1 further comprising locking means for interlocking said ring and yoke against relative rotation towards said first load releasing position, and linkage means for releasing said locking means and rotating said ring towards said first load releasing position from a remote location.

11. The coupler of claim 1, further comprising locking pin means insertable through aligned bores in said ring and yoke for interlocking said ring and yoke against relative rotation towards said first load releasing position.

12. The coupler of claim 11 further comprising spring means normally biasing said pin means away from said interlocking position, and latch means movable between a locked position for keeping said pin means in interlocking engagement with said ring and yoke against said spring bias, and a release position wherein said pin is released out of said interlocking engagement under urging of said spring bias.

13. The coupler of claim 12 further comprising linkage means actuatable for releasing said latch means from a remote location.

14. The coupler of claim 13 wherein said linkage means in a lanyard connected to said latch means and is actuatable by application of pulling force on said lanyard.

15. The coupler of claim 12, wherein actuation of said linkage means also effects rotation of said ring from said first load locking to said second load releasing position.

16. The coupler of claim 15, wherein said linkage means is a lanyard attached to said latch means and is actuatable by application of pulling force on said lanyard.

17. The coupler of claim 13, said ring having a radially projecting tab, one of said pin bores extending through said tab.

18. The coupler of claim 17, said latch means comprising a U-shaped clip mounted to said tab for pivotal movement about an axis parallel to the axis of said ring between a locking position wherein said clip overlies the radially outer end of said pin bore to keep said locking pin within said bore, and a release position wherein said clip is pivoted away from said overlying relationship to allow radially outward movement of the locking pin out of said interlocking engagement.

19. The coupler of claim 18, wherein said linkage is a lanyard connected to said U-shaped clip such that said clip moves from said locking to said release position in response to pulling force exerted on said lanyard.

20. The coupler of claim 1, wherein said slot in the ring extends approximately 180° of the ring circumference and between two circular openings having a diameter greater than the width of the slot.

21. The coupler of claim 1, wherein ring is held against axial displacement on said race and said socket further defines yoke bearing surfaces on which is seated said yoke and end surfaces holding said yoke against axial displacement relative to said ring.

22. The device of claim 1 wherein said yoke is a cylindrical body of slightly smaller diameter than the inner diameter of said ring.

23. A hoist coupling for use with an anchor embedded in a load, the anchor having a shaft portion and a head protruding from said load, said hoist coupling comprising:

a coupler body having a hemispherical underside, a socket formed in its upper side, said socket defining a ring race and yoke bearing surfaces, and a hole in said underside opening into said socket;

a ring seated on said ring race for rotation about a first axis, a circumferentially extending slot in said ring, said slot including at least one opening of enlarged diameter relative to the width of said slot;

a yoke extending through said ring and seated on said yoke bearing surfaces, there being an anchor head receiving recess in said yoke;

a bail having two bail arms, each arm having a lower end connected to said yoke for pivotal movement about a second axis, said second axis being parallel to but radially offset from said first axis in a direction away from said yoke recess; and means holding said lower ends of the bail arms against movement towards said coupler body such that said yoke is locked against rotation relative to said coupler body with said yoke recess in overlying alignment with said hole;

said ring being rotatable between a first load receiving position wherein said recess, said least one enlarged opening and said hole are aligned for admitting said anchor head through said body and said ring into said yoke recess, and a second load locking position wherein said ring is rotated to move said enlarged opening out of alignment with said recess and said hole such that the anchor shaft extends through said slot but the head is locked against withdrawal from said recess by the reduced width of the slot.

24. The coupler of claim 23, further comprising linkage means connected to said ring for effecting rotation of said ring from said second to said first position responsive to pulling force applied to said linkage means.

25. The coupler of claim 23, further comprising locking pin means insertable through aligned bores in said ring and yoke for interlocking said ring and yoke against relative rotation towards said first load releasing position.

26. The coupler of claim 25 wherein said pin means is releasable from said interlocking position responsive to pulling force applied to said linkage means to thereby free said ring for rotation from said first position to said second position responsive to further pulling force applied to said linkage means.

27. A hoist coupler for use with an anchor embedded in a load, the anchor having a shaft portion protruding from said load and terminating in an anchor head of enlarged diameter relative to said anchor shaft, said hoist coupler comprising:

a coupler body having an underside, a socket formed in its uper side defining a ring race and a hole in said underside opening into said socket;

a ring seated for rotation on said ring bearing surface, a circumferentially extending slot in said ring, said slot including at least one opening of enlarged diameter relative to the width of said slot;

a yoke extending axially through said ring, there being an anchor head receiving recess in said yoke, said yoke being secured to said coupler body with said recess in overlying alignment with said coupler body hole; and a bail pivotably connected to said yoke, the pivot axis of the bail being parallel to but offset from the axis of rotation of said ring in a direction away from said coupler body so as to allow pivotal movement of the bail against the surface of a concrete load with said coupler body partially sunk into said load;

said ring being rotatable about said yoke relative to said coupler body within said socket between a first load receiving and releasing position wherein said recess, said least one enlarged opening and said hole are aligned or admitting an anchor head through said body and said ring into said yoke recess, and a second load locking position wherein said ring is rotated to move said enlarged slot opening out of alignment with said recess and said hole such that the anchor shaft extends through said slot but the head is locked against withdrawal from said recess by the reduced width of the slot.

28. The coupler of claim 26, further comprising linkage means connected to said ring for effecting rotation of said ring from said second to said first position responsive to pulling force applied to said linkage means.

29. The coupler of claim 27, wherein said slot in the ring extends approximately 180° of the ring circumference and between two circular openings having a diameter greater than the width of the slot.

30. The coupler of claim 27, wherein said yoke is fixed to said coupler body by welding.

31. The coupler of claim 27, wherein said bail has two arms, and said yoke is cylindrical and is supported between said bail arms at points radially offset from the yoke cylinder's axis.

32. The coupler of claim 31, wherein said bail arms have lower ends received in bail arm recesses defined in said coupler body.

33. The coupler of claim 27, wherein said bail and said yoke are supported between lug ears provided on said coupler body.

34. The coupler of claim 33, wherein said yoke has cylindrical end pins rotatably extending through openings in said bail arms and said lug ears.

35. The coupler of claim 27 wherein said yoke is seated on yoke bearing surfaces defined in said socket.

36. The coupler of claim 27 wherein said underside of the coupler body is hemispherical.

37. The coupler of claim 27, further comprising locking pin means insertable through aligned bores in said ring and yoke for interlocking said ring and yoke against relative rotation towards said first load releasing position.

38. The coupler of claim 37 further comprising spring means normally biasing said pin means away from said interlocking position, and latch means movable between a locked position for keeping said pin means in interlocking engagement with said ring and yoke against said spring bias, and a release position wherein said pin is released out of said interlocking engagement under urging of said spring bias.

39. The coupler of claim 38 further comprising linkage means actuatable for releasing said latch means from a remote location.

40. The coupler of claim 39, wherein said linkage means is a lanyard connected to said latch, and said latch is releasable responsive to pulling force applied through said lanyard.

41. The coupler of claim 39, wherein actuation of said linkage means also effects rotation of said ring from said first load locking to said second load releasing position.

42. The coupler of claim 41, wherein said linkage means is a lanyard attached to said latch means and is actuatable by application of pulling force on said lanyard.

43. The coupler of claim 39, said ring having a radially projecting tab, one of said pin bores extending through said tab.

44. The coupler of claim 43, said latch means comprising a U-shaped clip mounted to said tab for pivotal movement about an axis parallel to the axis of said ring between a locking position wherein said clip overlies the radially outer end of said pin bore to keep said locking pin within said bore, and a release position wherein said clip is pivoted away from said overlying relationship to allow radially outward movement of the locking pin out of said interlocking engagement.

45. The coupler of claim 44, wherein said linkage is a lanyard connected to said U-shaped clip such that said clip moves from said locking to said release position in response to pulling force exerted on said lanyard.

46. An adapter for use between a female anchor embedded in a poured concrete structure and a hoist coupler device having a hemispherical body, said adapter comprising:

an adapter body defining a hemispherical socket, a frustoconical projection underlying said socket, and a bore through said head and said projection and opening centrally into said socket; and a male anchor including an anchor head at one end and an opposite threaded end, and stop means for positioning said anchor head in predetermined relationship to said adapter socket when the male anchor is inserted into said bore and through said adapter body.

47. An adapter for use between a female anchor embedded in a poured concrete structure and a hoist coupler device having a hemispherical body, said adapter comprising:

an adapter body defining a hemispherical socket, a frustoconical projection underlying said socket, an upper shaft portion extending from said body within said socket and terminating in an anchor head and a threaded lower shaft portion extending from said frustoconical projection in axial alignment with said upper shaft portion, both said shaft portions being integral with said adapter body.

48. A void for use in setting hoist anchors into poured concrete structures, the anchor having a shaft terminating in an anchor head, comprising:

two quarter spherical segments each having a common edge and an upper edge, retaining means for securing said two segments in joined relationship along said common edge to form a hemispherical shell, and semi-cylindrical means on each side segment together defining a receptacle shaped to interlock with an anchor head.

49. The article of claim 48 further comprising anchor head positioning means for fixing the anchor head in predetermined relationship to said hemispherical shell within said receptacle.

50. The article of claim 48 wherein said retaining means includes a lid for interlocking said two segments.

51. The article of claim 48 further comprising locator means extending upwardly from said lid so as to facilitate location of the void in the event it is covered by a layer of concrete.

52. The article of claim 48 wherein said retaining means further comprise a sleeve on said lid for receiving said two semi-cylindrical means and thereby interlock said two segments against separation from an anchor head captive in said receptacle.

53. The article of claim 48 wherein said retaining means comprise pin means on each said segment mateable into a corresponding hole on the other of said segments to thereby maintain the two segments in correct mutual alignment.

54. A hoist coupler comprising:

a coupler body apertured for receiving theretrough the head of an anchor affixed to a load, a bail including two bail arms, a yoke pivotably supported between said bail arms and having a yoke recess dimensioned for closely receiving the anchor head, a ring rotatable about said yoke between the yoke and the coupler body, said ring having a slot dimensioned for admitting passage of an anchor head passing through said coupler body and into said yoke recess in a load releasing position of said ring, and for preventing withdrawal of the anchor head from said yoke recess in a load retaining position of said ring.

55. The hoist coupler of claim 54 further comprising means for locking said ring in said load retaining position relative to both said yoke and said coupler body.

56. The hoist coupler of claim 53 further comprising linkage means connected to said ring for remotely rotating said ring from said load retaining position to said load releasing position responsive to pulling force applied to a distal end of said linkage means.

57. The hoist coupler of claim 55 further comprising linkage means connected for remotely unlocking said locking means and for rotating said ring from said load retaining position to said load releasing position responsive to pulling force applied to a distal end of said linkage means.

* * * * *